US006627063B1

(12) United States Patent
Marte et al.

(10) Patent No.: US 6,627,063 B1
(45) Date of Patent: Sep. 30, 2003

(54) METHOD AND APPARATUS FOR REDUCING VAT AND SULFUR DYES

(76) Inventors: Walter Marte, Barenfelsstrasse 3, Ulisbach (CH), CH-9631; Otmar Dossenbach, Elsternweg 11, Frauenfeld (CH), CH-8500; Ulrich Meyer, Kurvenstrasse 36, Zurich (CH), CH-8006

( * ) Notice: Subject to any disclaimer, the term of this patent is extended or adjusted under 35 U.S.C. 154(b) by 0 days.

(21) Appl. No.: 09/600,656

(22) PCT Filed: Nov. 24, 1999

(86) PCT No.: PCT/CH99/00562

§ 371 (c)(1),
(2), (4) Date: Aug. 31, 2000

(87) PCT Pub. No.: WO00/31334

PCT Pub. Date: Jun. 2, 2000

(30) Foreign Application Priority Data

Nov. 24, 1998 (CH) ..... 2338/98

(51) Int. Cl.[7] ..... C25B 3/00

(52) U.S. Cl. ..... 205/422; 205/413; 205/444

(58) Field of Search ..... 205/422, 413, 205/444

(56) References Cited

U.S. PATENT DOCUMENTS

| | | | |
|---|---|---|---|
| 3,640,803 | A | 2/1972 | Frind et al. |
| 3,953,307 | A | 4/1976 | Supanekar et al. |
| 5,350,425 | A | 9/1994 | Carver |

FOREIGN PATENT DOCUMENTS

| | | |
|---|---|---|
| WO | WO 90/15182 | 12/1990 |
| WO | WO 96/32445 | 10/1996 |

OTHER PUBLICATIONS

Bechtold et al., "The Reduction of Vat Dyes by Indirect Electrolysis", JSDC, vol. 110, Jan. 1994, pp. 14–19.*

T. Bechtold et al.; "Investigations to the electrochemical reduction of vat dyes"; *Melliand Textilberichte*; Jan. 1991; pp. 50–54. (English abstract attached).

T. Bechtold, et al.; "Elektrochemische Untersuchungen und Verfahren in der Textilindustrie"; *Textilveredlung*; 1990; pp. 221–226. (English abstract provided). month unavailable.

T. Bechtold, et al.; "The reduction of vat dyes by indirect electrolysis"; *JSDC*; Jan. 1994; vol. 110, pp. 14–19.

T. Bechtold, et al.; "Indirect Electrochemical Reduction of Dispersed Indigo Dyestuff"; *J. Electrochem.Soc.*; Aug. 1996; vol. 143, No. 8, pp. 2411–2416.

T. Bechtold, et al.; "Multi–cathode cell with flow–through electrodes for the production of iron (II)–triethanoloamine complexes", *Journal of applied Electrochemistry*; 1997; pp. 1021–1028. month unavailable.

T. Bechtold, et al.; "Schwefelfarbstoffe in der Ausziehfarberei– Reduktion durch indirekte Elktrolyse"; *Textilveredlung 32*; 1997; pp. 204–209. (English abstract provided). month unavailable.

(List continued on next page.)

*Primary Examiner*—Edna Wong
(74) *Attorney, Agent, or Firm*—Merchant & Gould P.C.

(57) ABSTRACT

The invention relates to a method for the electrochemical reduction of vat and sulfur dyes in aqueous solutions, in steady-state conditions of reaction and a cycle which is largely free of reducing agents. The invention also relates to apparatus for carrying out said method. The steady-state conditions of reaction are obtained by means of a start reaction. The substances used for this reaction and the products resulting therefrom are extracted from the cycle. To maintain the cycle only dyes, an alkali and possibly small quantities of additional substances, such as surface-active agents, need to be added. No other chemicals active in the oxidation-reduction process are used.

12 Claims, 1 Drawing Sheet

OTHER PUBLICATIONS

T. Bechtold, et al.; "Dyeing Behavior of Indigo Reduced by Indirect Electrolysis"; *Textile Res. J.*; Sep. 1997; pp. 635–642.

T. Bechtold, et al.; "Optimierung von Mehrkathoden–Membran–Elektrolysezellen zur indirekten elektrochemischen Reduktion von Indigo"; *Chemie Ingenieur Technik*; Oct. 1997; pp. 1453–1457. (English abstract provided).

.H. Daruwalla; "Savings in the use of chemicals in dyeing"; *International Dyer & Textile Printer*; Nov. 14, 1975; pp. 537–538.

E.H. Daruwalla; "Dyeing with less chemicals"; *Textile Asia*; Sep. 1975; pp. 165–169.

T. Bechtold, et al.; "Reduction of Dispersed Indigo Dye by Indirect Electrolysis"; *Angew. Chem. Int. Ed. Engl.*; 1991; No. 8, pp. 1068–1069. month unavailable.

G. Ackermann, et al.; "Elektrolytgleichgewichte und Elktrochemie, Fachstudium Chemie"; Bd. 5, S. 188; 1974; Verlag Chemie, Weinheim. (English translation of relevant parts). month unavailable.

Rompp; "Lexikon Chemie"; 10. Auflage, Thieme Verlag, S. 223; 1997. (English translation of the word Comproportionation). month unavailable.

* cited by examiner

METHOD AND APPARATUS FOR REDUCING VAT AND SULFUR DYES

The present invention relates to a process for electrochemical reduction of vat and sulfur dyes in aqueous solutions and equipment for carrying out the process.

The applications of vat and sulfur dyes on cellulosic materials takes place in the reduced form, since only these are water-soluble and possess a high affinity to the substrate. Through the oxidation carried out after the dyeing, the dye is again converted from its leuco form into the water-soluble pigment structure.

The application of vat and sulfur dyes for printing and dying of cellulosic fibers has up to now been connected to the introduction of over-stoichiometric reducing-agent quantities (with respect to the quantity of dye to be reduced). The reduction of the vat dyes takes place usually in alkaline (pH>9) aqueous solutions with sodium dithionite (hydrosulfite) or reducing materials derived therefrom (RONGALIT C, BASF) in connection with wetting and complexing agents. Other reducing agents such as thiourea dioxide or endiolate have hardly gained acceptance on the basis of cost, while in the case of thiourea dioxide, an environmental problem exists similar to that with hydrosulfite.

Reducing agents suitable for the reduction of vat dyes under the conditions necessary for vatting of dyes exhibit an oxidation-reduction potential of −400 mV to −1,000 mV. Both the use of hydrosulfite as well as thiourea dioxide lead to a high sulfite or sulfate pollution of the waste water. These salt loads, on the one hand, are toxic and, on the other hand, are corrosive and lead to destruction of the concrete ducts. Another problem caused by the sulfate load arising from the sulfite in the waste water is the formation by anaerobic organisms of hydrogen sulfide in the drain pipes.

Even newer processes can only partially solve the mentioned problem; here worth mentioning is the reduction in an ultrasonic reactor in connection with the usual reducing agents or the electrochemical vatting with the help of a mediator. The vatting in an ultrasound reactor offers the advantage that the reducing agent usage can be reduced to the stoichiometric ratio and the hydrosulfite can be replaced with endioles.

The direct electrochemical reduction of dye pigments has not been realized up to now. A known electrochemical process utilizes hydrosulfite, from which other reaction products arise that reduce the dye, which products lead to a diminishing of the quantity of the application of hydrosulfite necessary for dye vatting (E. H. Durawalla, Textile Asia, 165-9, September 1975).

Another known process utilizes oxidation-reduction systems such as, for example, iron (II)- or iron (III)-complexes (T. Bechtold et al., Angew. Chem. Int. Ed. English 1992, 31, No. 8, 1068-9; WO 90/15182).

With all these electrochemical vatting processes the agent that reduces the dye is the applied reducing agent or mediator. The mediator system is electrochemically cathodically regenerated according to the example mentioned above (e.g., $Fe^{2+}$<–>$Fe^{3+}$). Due to the high usage quantity and the disturbing ecological nature of such mediators, an acute environmental problem arises after as well as before, which can be resolved only with additional investment in appropriate waste water technology or through a recycling process. Another disadvantage of the process is the permanent replenishing of the mediator for maintaining the oxidation-reduction cycle in continuous dyeing technology. The replenishing of the mediator system arises from the bath discharge that is proportional to the fabric or thread flow.

Up to now it was not possible to reduce vat dyes electrochemically on a commercial scale without the addition of a mediator. The causes of the mentioned difficulty are predetermined by the dye pigment, since this exhibits a completely inert behavior in an electrolysis cell, through its lack of solubility in water.

The object of the present invention is therefore, while avoiding the mentioned disadvantages of known reducing processes, to make available a vat dyeing process generally free of reducing agents for the production of completely reduced dye solutions for the dyeing of cellulosic textile materials.

The object is solved through a process for electrochemical reduction of vat and sulfur dyes in aqueous solutions, characterized by the fact that two dye-radical anions (2R) are formed (reaction equation I) in a com-proportionization reaction between a dye (A) and its reduced form (P), resp. species (P), that the two dye-radical anions (2R) are reduced electrochemically (reaction equation (II)) to the same species, $$A+P\rightarrow 2R \quad \text{(I)}$$

$$2R+2e^{-}\rightarrow 2P \quad \text{(II)}$$

that the reaction equations (I) and (II) form a steady-state cycle, that the reaching of the steady-state reaction conditions is effected through a start reaction, and that the steady-state cycle is maintained, whereby the formed species (P) on the one hand is necessary for maintaining the circuit and on the other hand is used for the dyeing process. The object is also solved through equipment for carrying out the process according to one of the claims 1–10, characterized by the fact that for a dye suspension (A) located in an electrolysis vessel (1) provision is made for a circuit with a circulation stream (V1'), whereby the electrolysis vessel (1) is fitted out with electrodes 6, 6', that provision is made for a like dye suspension, located in a second vessel (11), for introduction with a first volume stream (V2') into the circuit via conduits (14, 14') and a pump (P2), that the electrolysis vessel (1) is fitted out with second conduits (15, 15') and a second pump (P3) for the removal of a volume stream (V3') of a quantity equivalent to the first volume stream (V2'), whereby the second conduit (15') is connected to a third vessel (21).

BRIEF DESCRIPTION OF THE DRAWINGS

The process and the associated equipment are described in the following. Shown are.

The process is essentially based on a closed loop reaction, which is maintained under steady-state reaction conditions, and is described through the following reaction equations (I) and (II):

$$A+P\rightarrow 2R \quad \text{(I)}$$

$$2R+2e^{-}\rightarrow 2P \quad \text{(II)}$$

The dye A reacts with the reduced dye species P, in the following indicated for short by the species P, which represents the dye in the leuco form, in a comproportionation reaction (I), in which two dye radical anions 2R form.

By comproportionation is indicated a reaction in which a higher and a lower oxidation step of an element or of a chemical bond come together to an average. (G. Ackermann, et al., Elektrolytgleichgewichte und Elektrochemie, Fachstudium Chemie, Vol. 5, Page. 188 (1974), Verlag Chemie, Weinheim; Römpp, Lexikon Chemie, edition 10, Thieme Verlag, Page 2223 ((1997)).

In a second step the two dye radical anions 2R, which due to their charge are soluble in water, are reduced electrochemically according to reaction equation (II) at a cathode to the dianion, or more precisely, the species 2P. In order to achieve this, a D.C. voltage is impressed on the available cathodes, the voltage being suitable for the oxidation-reduction potential of the dye radical anions 2R. With correctly selected voltage relationships, for the remaining process a vat dyeing free of reducing agent can be carried out, while taking into consideration the comproportionation reaction.

Figure 1:
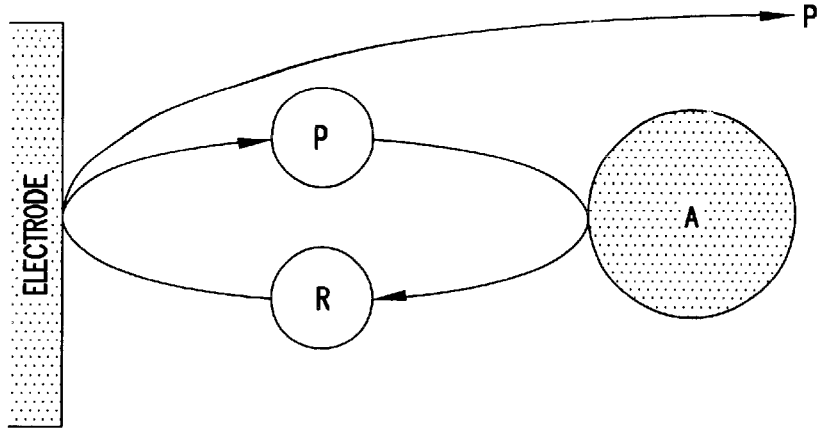
FIG. 1 schematic representation of the electrochemical vatting

FIG. 1 shows in schematic representation the electrochemical vatting just described.

The achievement of the steady-state reaction conditions is made possible by various start conditions, which will be described later.

The dye reduction takes place in an oxygen-free electrolysis vessel, which contains not only electrodes but also a general purpose mixing apparatus. Diverse cell connections allow, on the one hand, the continuous and, on the other hand, batch operation of the electrolytic apparatus.

The dye pigment A is introduced into the electrolysis vessel in an aqueous suspension containing diverse additives. The alkaline pH-value necessary for dye reduction lies between 10.5–13, which is adjusted with alkalimetalhydroxide, in particular sodiumhydroxide solutions. As additives, according to the desired reaction start conditions, Tenside, reducing agents and solvents are introduced in low concentrations. According to the invention, the additives used, after a successful start of the reaction, can be precipitated out or, to be precise, modified in their concentration.

The start reactions that lead to the steady-state reaction conditions are described in the following with the aid of reaction equations (IIIA)–(IIIC).

The reaction equation (IIIA) shows a first start reaction:

$$A+B \rightarrow P \qquad \text{(IIIA)}$$

As a reaction starter, in the simplest case a conventional reducing agent B is introduced that is suitable for the reduction of vat dyes, for example hydrosulfite or an endiolate in a sub-stoichiometric ratio with respect to the dye A.

Thus the reducing material B, for short called starter or reducing starter, in correspondence to its applied amount reduces an amount of dye to species P or to the di-anion.

After the onetime addition of sub-stoichiometric reducing starter, merely the addition of more dye pigments and alkali as well as any possible low amount of additives suffice for the maintaining of the steady-state vatting operation, whereby the reduction process introduced through the start conditions is determined subsequently only through the reaction equations (I) and (II).

Thus the process according to the invention distinguishes itself essentially completely from a reaction operation which uses a mediator that must be permanently present in a coercive way.

As reducing starter, B sub-stoichiometric amounts of the following compounds are used:

hydrosulfite and its derivatives, such as, for example, formeldahydsulfoxylate (RONGALIT C, BASF), thiourea dioxide, glucose, α-hydroxyketones, such as, for example, monohydroxyacetone, dihydroxyacetone, α-hydroxyaldehydes, such as, for example, glycolaldehyde, triose-redukton (2,3-dihydroxyacrylaldehyde) or reductin acid (cyclopentendiol-on).

The reaction equations (IIIB) show a second start reaction:

$$A+X \rightarrow (AX)_{sol} \qquad \text{(IIIB.1)}$$

$$(AX)_{sol}+2e^{-}P \qquad \text{(IIIB.2)}$$

In order to introduce the electrochemical reduction, additives of dye-affine solubilizing or dispersing agents are added, which, for short, are denoted as auxiliary agents X. The dye A, or more precisely the dye pigment, forms with these auxiliary agents a solubilized complex $(AX)_{sol}$ (IIIB.1), which is reduced electrochemically to species P (III.B2). The auxiliary agents thus enable a direct electrochemical reduction of the micro-dispersed coloring pigments present, whose behavior due to solubilization is similar to a dissolved compound.

As auxiliary agents X, or more precisely as dye-affine solubilizing or dispersing agents, the following compounds are uses:

ketones, such as, for example, N-methylpyrrolidon, 4-hydroxy-4-methylpentanon-2 (diacetone alcohol), alcohols, such as, for example, methanol, ethanol, isopropanol, the methanol and isopropanol being especially preferred, acetals, such as, for example, glycolformal, and glycerineformal, glycols and glycol ethers, such as, for example, propyleneglycol, ethyleneglycolmonomethyl-, ethyl- or -butylether, diethyleneglycolmonomethyl- or -ethylether, pyridines, such as, for example, pyridine and α-, β-, and γ-picolines, lactams, such as, for example, pyrrolidone, N-methylpyrrolidone, and 1,5-dimethylpyrrolidone, acids and acid amides, such as, for example, benzosulfonic acids, naphthalene sulfonic acid derivatives, such as, for example, Setamol WS (naphthalene sulfonate condensed with formaldehyde), N,N-dimethylformides and acetamide.

The auxiliary agents are used in amounts of approximately 1 to 90%, preferably 5 to 30%, with respect to the dye quantity used. For supporting the solubilizing or dispersing by means of the described auxiliary agents, the use of ultrasound has proven itself as a dispersion aid. Here, during or before the reduction of the dye the suspension is impinged upon with ultrasound energy.

The reaction equations (IIIC) show a third start reaction:

$$S \rightarrow S^{*} \qquad \text{(IIIC.1)}$$

$$S^{*}+A \rightarrow R \qquad \text{(IIIC.2)}$$

A radical starter S is activated through the effect of physical means, such as UV-radiation, cobalt radiation and/ or ultrasound, whereby it is converted into an excited state S* of the radical starter (IIIC.1). This reacts with the dye A, from which a radical anion R arises (IIIC.2). Thus the conditions are given that the steady-state cycle with the reaction equations (I) and (II) can use.

Used as a radical starter are benzophenone, its diarylketone derivatives, anthraquinones as well as xanthones. Other compound classes suitable as radical starters are azo-compounds and diazonium salts (e.g., azo-isobutyronitril).

For sustaining the radical formation, UV-sources, or more precisely any kind of radiation source of even harder radiation, and ultrasound can be used in known ways. The ultrasound waves, which are sufficient for application according to the process, are generated with the usual ultrasound generators. Their frequency lies in the range of 16 kHz and above, preferably at 20 to 30 kHz. The ultrasound energy to be applied depends on the dye or rather on the radical forming substance and the size of the reaction vessel. Usually powers between 0.5 and 1 kW are applied, in order to generate the cavitation required for radical formation.

Combinations of reduction starter with solubilizing- or dispersing agents show synergistic effects such that, in the start phase, the reaction speed to be achieved is greater than that with the reduction starter or the solubilizing- or dispersing agent alone. With increasing reaction conversion the reaction speed rises due to the superposition of the comproportionation reaction and the reaction process described earlier with the applied solubilizing and dispersing agents. Preferred combinations for starting the reaction are hydrosulfite as starter and certain naphthsulfone acids (Setamol WS of the firm BASF Ludwigshafen) or their combinations as dispersing.

For accelerating the reaction, utilized as additives according to the invention are ionic or non-ionic surfactants as well as protic and aprotic solvents (as described earlier), which exhibit an affinity for dyes and for electrodes and do not themselves work as a reducing agent, Typical representatives of these substances are alcohol propoxylate such as, for example, Lavotan SFJ, alcoholsulfates such as, for example, Sandopan WT, Subitol MLF and alkylsulfonates such as, for example, Levapon ML.

The amounts of these additives used lie in the range of 0.1 to 10 g/l; preferred concentrations lie between 1 and 5 g/l.

With the process according to the invention, surprisingly advantages were achieved in the area of the dyeing of cellulosic materials with vat dyes, especially with indigo.

The big advantage of this reaction process lies in the single starter chemical addition to be effected at the beginning of the, reaction. With this, in the subsequent course (I) and (II) of the reaction in an oxygen-free reaction cell, necessary for sustaining a reaction are only the vat dyestuff that is consumed in the dyeing, the necessary alkali for adjusting the pH, an appropriate electrical voltage to maintain the reaction, as well as any small amount of additives. The described reduction technique, in connection with an oxygen-free cell, even after long downtime allows a renewed reaction start without any kind of starter additive. Through a vatting potential suited to the comproportionation step (I) and suitable electrode materials an over-reduction of the dyestuff is prevented, which is very often encountered with hydrosulfite and thiourea dioxide as reducing agents. Conditioned by the extensive lack of salts, concentrations of up to 200 g/l can be reached in the textile stock vat. The high dye solubility is of special significance, because through concentrated stock vat baths, dye overflow in dye baths can be prevented.

This vatting technique furthermore leads to an extensively salt-free dying, whereby automatically a higher reproducibility and better fabric or thread quality can be assured. Further advantages are the high stability of the reduced stock vat bath in oxygen-free electrolysis vessels, the high dye solubility of the vatted species, the continuous dye reduction and thus the "just in time" production of the dye solution.

The reduction technique is just as suitable for initial dye stocks as it is for dye baths. The enormous economic advantage thus lies in the lowering of the consumption of chemicals (reducing agent and caustic soda), the production of a better quality product and essentially lower waste water costs due to the now present biocompatibility of the remaining content of the waste water. In regard to the waste water, no toxic pollution arises, there being the possibility of recycling the waste water at little expense compared to that for conventional dye systems.

As electrode material, essentially all electrically conductive materials can be used which are stable in the alkaline range (pH 9 to 14) and which exhibit no oxygen formation at the reduction potential necessary for the dye reduction. To these also belong those electrodes that are modified with a special surface treatment. This can take place through adsorption of special surfactants with a typical HLB value (hydrophiliclhydrophobic balance) from 8 to 14 or through a partial coating with a hydrophobic polymer suspension. Typical substances are, polytetrafluoroethylene, [tetrafluoroethene-oligomer and polystyrene The size of the electrode surface is determined by the required vatting power and is designed to be specific to the reaction.

The voltage applied to the electrodes is a function of the vatting potential of the dye (taking into consideration the comproportionation reaction) and depends also on the nature of the electrodes.

Usually voltages of from 2.3 to 2.6 V are applied.

Figure 2:
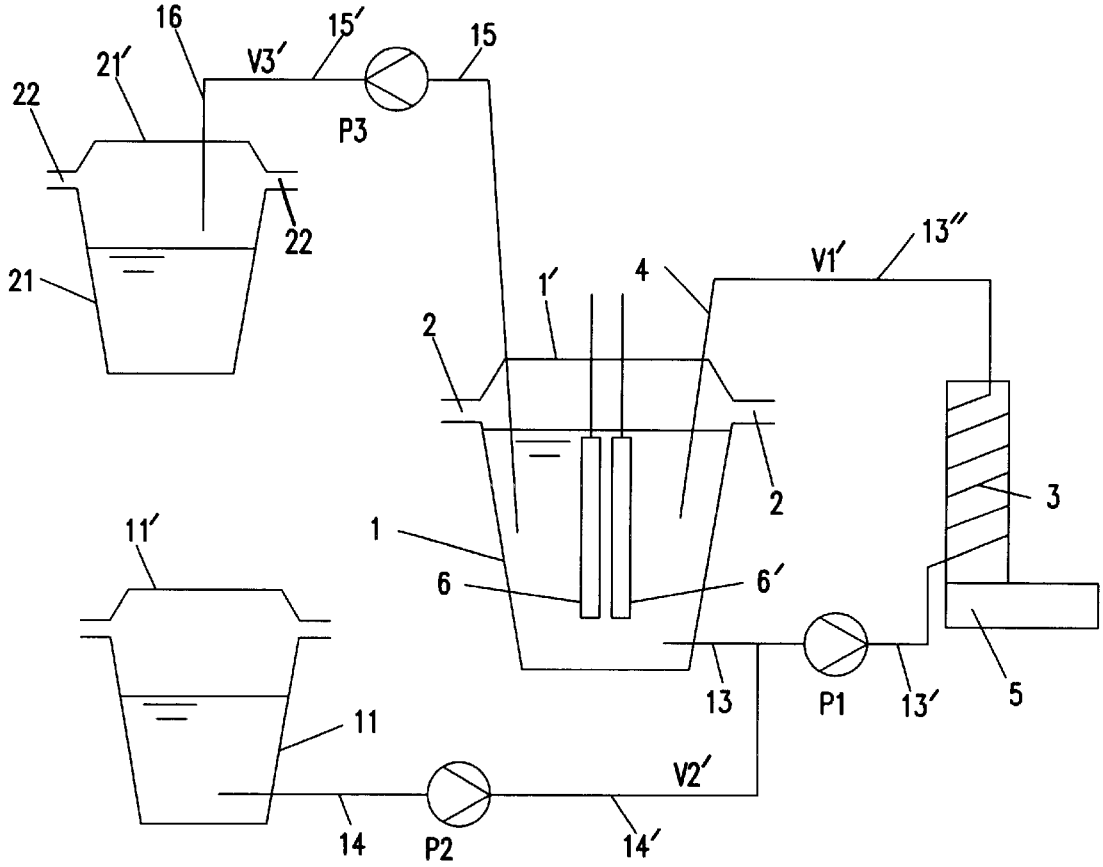
FIG. 2 schematic representation of equipment for continuous electrochemical dye reduction By vat dyes in the sense of the present invention are also to be understood, besides the indigoid dyes, where indigo itself is preferred, anthraquinoidal dyes and, if applicable, sulfur dyes that are not previously reduced.

FIG. 2 shows in schematic representation equipment for continuous electrochemical dye reduction.

An electrolysis vessel 1 with cover 1', tightly closed off by seal 2, is a component of a circuit with the conduit 13, with a pump P1, a conduit 13', a steel pipe spiral 3, a conductor 13" and an inlet pipe 4, which leads through the cover 1' back into the electrolysis vessel 1. The steel spiral 3 is located on an ultrasound oscillator 5. The energy fed into the ultrasound oscillator 5 amounts to 100–1000 Watts and serves the formation of radicals and dye dispersion. The dye suspension in the electrolysis vessel 1, along with the alkali and the additives dependent on the selected start reaction, is guided in a circulating current V1' by means of a pump P1 in the circuit during the entire vatting period, whereby the steel pipe spiral 3 along with the ultrasound oscillator 5 works as a dispersing aid.

In the electrolysis vessel 1 furthermore is located an electrode pair 6,6', to which an electrical voltage of about 2.2 volts is applied after the completion of the start reaction.

This condition is maintained until the entire quantity of dye present is completely reduced.

In the subsequent reaction phase steady-state reaction conditions arise, a volume stream V2' of dye suspension being continuously fed into the electrolysis vessel 1 and an equivalent volume stream V3' of reduced dye being carried away.

For this purpose, a dye suspension equal to the orignally present dye suspension is fed by means of a pump P2 from a second vessel 11 with cover 11' with a volume stream V2' via conduits 14, 14' into conduit 13 and thus to the circulating stream V1'.

At the same time, a volume stream V3', corresponding to the volume stream V2', is taken from the electrolysis vessel 1 and by means of a pump P3 is metered via conduits 15, 15' and an inlet pipe 16 into an oxygen-free supply vessel 21, which is sealed off with a cover 21' and a seal 22. The electrochemical dye vatting carried out in this way without reducing agents corresponds to the principles of the continuous reaction operation in an ideally mixed stirring vessel.

After about 6T the bath content of the electrolysis vessel is so extensively exchanged that neither the chemicals used for the start reaction nor the reaction products arising from them are present in the electrolysis vessel.

T corresponds to the hydrodynamic residence time that is defined by the quotient of the volume of the reaction vessel V1 over the volume stream V2' that is fed in or lead away, according to the relationship T=V1/V2'. A complete exchange (>99.9%) of the reaction volume is achieved after 6T.

The present invention is explained in detail through the following example, without claiming to have fully described the technical potential of the invention.

Example 1 describes an electrochemical batch vatting with a reducing agent B according to start reaction (IIIA).

—10 g indigo are dispersed in 1.00 ml of water, which at the same time contains 4.0 g of caustic soda and 1 ml of a 10% Subitol SE solution (BEZEMA AG) as wetting agent, and is placed in thermostatically controlled electrolysis vessel at 40° C. After this, while excluding oxygen, an addition of 1.7 g of hydrosulfite takes place. This corresponds to approximately 0.25 oxidation-reduction equivalent with respect to the amount of indigo present. After approximately 30 minutes the start reaction has ended and the dye lies, in an amount proportional to the reducing agent stoichiometry, as a dianion, corresponding to the adjusted pH value of approximately 12.5. Now the voltage of 2.3 volts is applied to the electrodes that are present. The working current amounts to approximately 1.5 A. These conditions are maintained for 2 hours in order to completely reduce the residual dye.

With 20 ml of this initial stock vat material a dye solution is produced whose dye concentration amounts to 5 g/l. The dyeing takes place, while excluding oxygen, with 10 g of cotton fabric at a temperature of 30° C. for 10 minutes. After completion of the dyeing period the sample is oxidized in air, rinsed and finally washed at 50° C.

The sample thus produced exhibits a brilliant blue hue, and the color depth is identical with that of a color sample produced according to the conventional dyeing method with sodium hydrosulfite.

Example 2 describes a first continuous electrochemical vatting according to start reaction (IIIB) with solubilizing and dispersing auxiliary agents. The electrochemical vatting is carried out in equipment according to FIG. 2. 5 g indigo are dispersed in 100 ml of water, which at the same time contains 3.5 g caustic soda and 2 g Setamol SW as dispersing agent. The dye suspension is placed in an oxygen-free, stirred electrolysis vessel equipped with electrodes 6, 6' and thermo-statically held at 40° C.

The dye suspension is pumped during the total vatting time in a loop with a circulating current V1' of 20 ml/min.

The working voltage applied to the electrodes amounts to 2.0 V with a current of 2.0 A. After approximately 40 minutes under the given conditions there results in the electrolysis vessel a 100% reduction of the dye dispersion.

The power supplied to the ultrasound oscillator is approximately 150 watts and serves for the radical formation and dye dispersion.

Finally, a 5% indigo suspension is moved by the pump P2 from the second vessel 11 with a flow volume V2' of 1.5 ml/min to the circulating stream V1'. The indigo suspension in the second vessel 11 possesses the same composition as was described at the beginning. In parallel a volume flow V3' of 1.5 ml/minute, corresponding to the dye inflow V2', is taken from the electrolysis vessel 1 and is metered into the oxygen-free vessel 21 by means of pump P3.

After approximately 40 minutes (approximately 6T) the bath content of the electrolysis vessel is so well exchanged that start chemicals are no longer present and the further reduction takes place through the reactions described in the reaction equations (I) and (II).

This operation condition is maintained for another hour, in order to demonstrate the absolutely starter-free, electrochemical direct vatting.

The vatting grades analyzed within this time period exhibit vatting values of >95%. The dyeings that were produced with this solution correspond in all criteria (color depth and quality) to those achieved with conventionally produced dye vatting baths.

Example 3 describes a second continuous electrochemical vatting of indigo with the aid of solubilizing or dispersing auxiliary agents according to the start reaction (IIIB).

5 g indigo are dispersed in 100 ml water in which beforehand 2 g of Setamol WS and 5 ml methanol were placed. In addition to this, 3 g caustic soda are added to the suspension, which then is put into the nitrogen-flushed and stirred electrolysis vessel. The heatable electrolysis vessel is thermostatically maintained at 35° C. After reaching the temperature of 35° C. the current (2.2 V, 2.0 A) is turned on for the electrochemical dye vatting.

Through the addition of methanol and Setamol WS, a portion of the most finely dispersed dye behaves similarly to the dissolved dye species, which now is adsorbed and reduced directly at the electrode. With increasing formation of the dye dianions, the reaction steps dominate that lead to the dianion by way of a comproportionation.

After completion of the start reaction (approximately. 2 hours), the continuous process is begun. For this, merely a suspension (without methanol) containing Setamol WS (3 g/l) and indigo (50 g/l) is introduced at a volume flow of 1.5 ml/min in the electrolysis cell. The volume flow removed from the vessel is likewise 1.5 ml/min and contains the dye reduced by more than 95%. The Setamol WS introduced during the continuous operation leads in the above-described process to a synergistic effect, which reveals itself in an increased reaction rate.

The advantages of this process technology are analogous to those cited in the previously described examples, where the vatting speed can be increased through variation of the dispergent concentration.

Example 4 describes an electrochemical vatting with a photochemical start reaction according to start reaction (IIIC).

5 g indigo are dispersed in 200 ml of water, which contains 2 g caustic soda and 10 ml of methanol, dispersed with the aid of ultrasound. Then added to the dye suspension is 0.5 g Michler's ketone (4,4-Bis(N,N-dimethyl-amino) benzophenone) as radical starter. The reaction mixture is placed in a nitrogen-flushed, stirred reaction vessel thermostatically maintained at 30° C., the vessel being fitted with a UV source parallel to the electrodes. After complete oxygen exchange (after approximately 10–15 min.) both the UV source and the electrolysis are switched on. The UV source operates with an emitter power of 150 watts, whereby the maximum of the energy distribution lies at approximately 250 nm. The voltage applied to the electrodes is 2.0 V at a current flow of 1.7 A.

Under the stated reaction conditions there results a photochemical excitation of the Michler's ketone accompanied by formation of radicals. In a subsequent step, the electron of the radical starter is transferred to a dye molecule, accompanied by formation of the dye monoanion radical, which is electrochemically reduced to a dye dianion according to reaction scheme (IIIC.2).

After complete reduction of the dye, the UV source is turned off and the continuous vatting is started, which is carried out exclusively electrochemically.

For this, a dye volume flow of 1 ml/min. of a dye suspension with 25 g/l of indigo and 3 g/l of sodium hydroxide (without radical starter and methanol) is fed into the electrolysis vessel and at the same time a volume flow of 1 ml/min. is drawn from the electrolysis vessel. The reaction vessel is operated as an ideally-mixed stirring vessel, with which, under the given conditions in the reactor outlet, a vatting grade of >95% was achieved.

The vatting stock solution thus continuously produced still contains only dye and caustic soda, because the initially introduced reactor starter and the methanol are completely removed after approximately 6T and the dye reduction takes place directly, without any other auxiliary agents.

The dyeings produced with these solutions, in all the criteria for dyes, exhibit results analogous to those that are also achieved with conventionally produced (hydrosulfite) dye solutions. Besides the advantages relating to dyes (lower costs; lower salt pollution of the dye baths, higher dye solubility) a far lower environmental pollution results in comparison to the conventional process, or to be precise, the process carried out electrochemically using a mediator additive.

The following aspects reveal themselves as essential to the invention:

No materials are used that are problematic with respect to the environment.

In the continuous operation, except for dye and caustic soda and any possible small amount of additive, no other chemicals effective in the oxidation-reduction process are used.

The reaction starter or auxiliary agents necessary for starting the reaction are only used in small amounts.

The recovery of expensive or environmentally relevant materials (e.g., mediator system) is obviated.

The required reduction starter for the start phase or auxiliary agents and their amount used can be optimally adapted to the desired conditions (reaction rate, costs, etc.).

Through the combination of ultrasound and direct electrochemical dye reduction, substantially higher vatting rates can be achieved with simultaneous minimization of the auxiliary agent usage.

Through the various possibilities of the reaction start and the combination of direct electrochemical reduction with ultrasound, one can use dye baths and auxiliary agents of different qualities and of different producers without thereby having to expect disturbances in the reaction process.

Side reactions, such as, for example, dye precipitation, sludge formation and corrosion, cannot occur as they can with the use of a mediator.

What is claimed is:

1. Process for electrochemical reduction of vat and sulfur dyes in aqueous solutions for use in a dyeing procedure, said process comprising the steps of:

a) forming two dye-radical anions in a comproportionation reaction between a dye and its reduced form according to a first reaction $$A+P\rightarrow 2R$$

wherein A is said dye, P is said reduced form of said dye and R is a dye-radical anion and wherein said two dye-radical anions are electrochemically reduced to form said reduced form of said dye according to a second reaction $$2R+2e^{-}\rightarrow 2P$$

wherein R and P are as defined above, and $e^{-}$ is an electron, and wherein said first and said second reactions form a steady-state reaction cycle;

b) reaching steady-state reaction conditions in said steady-state reaction cycle through the effect of a start reaction; and c) maintaining said steady-state reaction cycle wherein said reduced form of said dye is necessary for maintaining said steady-state reaction cycle.

2. Process according to claim 1, wherein said start reaction comprises the reaction between said dye and a reducing agent according to reaction $$A+B\rightarrow P$$

wherein A and P are as defined above, and B is a conventional reducing agent, wherein said start reaction takes place between said dye together with a sub-stoichiometric quantity with respect to said reducing agent to form said reduced form of said dye, wherein said steady-state reaction cycle of said first and said second reactions leads into said steady-state reaction conditions.

3. Process according to claim 2, wherein said reducing agent is hydrosulfite, a hydrosulfite derivative, thiourea dioxide, glucose, an α-hydroxyketone, an α-hydroxyaldehyde, a triose-reduction acid, a reduction acid, or a combination thereof.

4. Process according to claim 1, wherein said start reaction comprises the reaction between said dye and an auxiliary agent acccording to the reaction $$A+X\rightarrow (AX)_{sol}$$

wherein A is defined as above, X is an auxiliary agent, and $(AX)_{sol}$ is a solubilized complex of said dye and said auxiliary agent wherein said reaction takes place between said dye trough the aid of said auxiliary agent, wherein said solubilized complex of said dye and said auxiliary agent being electrochemically reduced according to the reaction $$(AX)_{sol}+2e^{-}\rightarrow P,$$

wherein $(AX)_{sol}$, $e^{-}$, and P are as defined above, and wherein a small amount of said reduced form of said dye is formed, whereby said steady-state reaction cycle of said first and said second reactions leads into said steady-state reaction conditions.

5. Process according to claim 4, wherein said auxiliary agent is a ketone, an alcohol, an acetale, a glycol, a glycol ether, a pyridine, a lactam, an acid, a naphthaline sulfonic acid derivative, an acid amine, or a combination thereof.

6. Process according to claim 5, wherein said alcohol is methanol, isopropanol, or a combination thereof.

7. Process according to claim 1, wherein said start reaction comprises the reaction between said dye and an excited state of a radical starter according to the reaction $$S^*+A \rightarrow R$$

wherein A and R are as defined above, and S* is an excited state of a radical starter wherein said start reaction takes place by forming a radical anion by activating said excited state of said radical starter through the effect of physical means according to the reaction $$S \rightarrow S^*,$$

wherein S is said radical starter, and S* is said excited state of said radical starter, and wherein by formation of said radical anion said first and said second reactions lead into said steady-state reaction cycle which leads into said steady-state reaction conditions.

8. Process according to clam 7, wherein said radical starter is benzophenone, a benzophenone diarylketone derivative, an anthraquinone, a xanthone, an azo-compound, a diazonium salt, or a combination thereof.

9. Process according to claim 7, wherein said physical means are energetic radiations.

10. Process according to claim 9, wherein said energetic radiations are used in combination with ultrasound.

11. Process according to claim 7, wherein said physical means are UV radiation, cobalt radiation, ultrasound, or a combination thereof.

12. Process according to claim 1, wherein said dye is an indigoid dye, an anthraquinoid dye, a sulfur dye, or a combination thereof.

* * * * *

UNITED STATES PATENT AND TRADEMARK OFFICE

CERTIFICATE OF CORRECTION

PATENT NO. : 6,627,063 B1
DATED : September 30, 2003
INVENTOR(S) : Marte et al.

It is certified that error appears in the above-identified patent and that said Letters Patent is hereby corrected as shown below:

Column 1,
Line 14, “dying of cellulosic” should read -- dying of cellulosic”

Column 3,
Line 35, “alkalimetalhydroxide, in particular sodiumhydroxide” should read
-- alkali metal hydroxides, in particular sodium hydroxide --
Line 37, “conditions, Tenside, reducing” should read -- conditions, tenside, reducing --
Line 55, “After the onetime addition” should read -- After the single addition --

Column 4,
Line 2, “formeldahydsulfoxylate” should read -- formaldehyde sulfoxylate --
Line 30, “are uses:” should read -- are used: --

Column 5,
Line 5, “can use.” should read -- can start. --
Line 40, “alcoholsulfates such as,” should read -- alcohol sulfates such as, --

Column 6,
Line 28, “[tetrafluoroethene-oligomer and polystyrene” should read
-- tetrafluoroethene-oligomer and polystyrene. --

Column 7,
Line 25, “–10 g indigo are dispersed in 1.00 ml of water,” should read -- 10 g indigo are dispersed in 100 ml of water, --

Column 10,
Line 53, “said dye trough” should read -- said dye through --

UNITED STATES PATENT AND TRADEMARK OFFICE

CERTIFICATE OF CORRECTION

PATENT NO. : 6,627,063 B1
DATED : September 30, 2003
INVENTOR(S) : Marte et al.

It is certified that error appears in the above-identified patent and that said Letters Patent is hereby corrected as shown below:

Column 12,
Line 5, "clam 7," should read -- claim 7, --

Signed and Sealed this

Fifteenth Day of June, 2004

JON W. DUDAS
*Acting Director of the United States Patent and Trademark Office*